United States Patent [19]

Hamisch, Jr.

[11] 4,125,420

[45] Nov. 14, 1978

[54] HAND-HELD LABELER

[75] Inventor: Paul H. Hamisch, Jr., Franklin, Ohio

[73] Assignee: Monarch Marking Systems, Inc., Dayton, Ohio

[21] Appl. No.: 816,846

[22] Filed: Jul. 18, 1977

[51] Int. Cl.[2] ..... B65C 9/26

[52] U.S. Cl. ..... 156/384; 101/288; 156/541; 156/584

[58] Field of Search ..... 156/277, 384, 540, 541, 156/542, 576, 577, 579, 584; 101/288, 291, 292

[56] References Cited

U.S. PATENT DOCUMENTS

| | | | |
|---|---|---|---|
| 1,665,467 | 4/1928 | Miller | 101/19 |
| 3,408,931 | 11/1968 | Austin | 101/318 |
| 3,656,430 | 4/1972 | Olsson | 101/288 |
| 3,705,833 | 12/1972 | Wada | 156/384 |
| 3,782,279 | 1/1974 | Carboni et al. | 156/384 |
| 3,800,701 | 4/1974 | Martin | 156/384 |
| 3,911,817 | 10/1975 | Becker et al. | 156/384 |

FOREIGN PATENT DOCUMENTS 2,530,346 1/1977 Fed. Rep. of Germany.

*Primary Examiner*—Caleb Weston

*Attorney, Agent, or Firm*—Joseph J. Grass

[57] ABSTRACT

There is disclosed a hand-held apparatus for printing and applying pressure sensitive labels, the apparatus having a frame with a handle, an actuator disposed at the handle and movable between an initial position and an actuated position, a platen, a print head cooperable with the platen, a label delaminator adjacent the platen, a label applicator adjacent the delaminator, a feed wheel for advancing the web, a stop on the actuator, a pivotally mounted print head lever, a spring for urging the print head lever against the stop, ratchet teeth coupled to the feed wheel, a first pawl carried by the actuator and cooperable with the ratchet tooth to drive the feed wheel, the print head lever having a tooth, a second pawl cooperable with the tooth after the actuator has moved from an initial position through an increment toward the actuated position, the second pawl being effective to prevent rotation of the lever as the actuator is moved through an additional increment toward the actuated position, and a projection carried by the actuator for releasing the second pawl from the lever tooth when the actuator has moved through the additional increment to enable the spring to drive the print head into printing cooperation with the platen.

9 Claims, 5 Drawing Figures

HAND-HELD LABELER

BACKGROUND OF THE INVENTION

1. Field of the Invention

This invention relates to the art of hand-held labelers.

2. Brief Description of the Prior Art

U.S. Pat. No. 1,665,467 to David B. Miller dated Apr. 10, 1928 discloses a stamping device in which a pivotally mounted hammer is tripped into printing cooperation with a marking stamp.

U.S. Pat. No. 3,408,931 to Charles C. Austin dated Nov. 5, 1968 discloses a hand-held label printer in which a print head is mounted for straight line reciprocating movement. This patent discloses cocking means responsive to an actuator for moving the print head from printing to a retracted position during the cycle, a detent for holding the print head in the retracted position during a subsequent part of the cycle, and trip means responsive to the actuator at or near the end of the cycle to disengage the detent, thereby permitting a spring to snap the print head into printing position.

Published German patent application No. P 23 45 249.5-27 (2530346) of Meto International GmbH discloses a hand-held labeler having an actuating lever and a spring-urged print head lever. The spring may be cocked by swinging the actuating lever up to the point of reaching a spring force which is greater than the maximum of resistance opposed to the movement of the printing mechanism toward the platen. When this occurs, the print head will be snapped against the platen with constant force independent of the force or speed of movement of the actuator lever.

U.S. Pat. No. 3,911,817 to Werner Becker et al dated Oct. 14, 1975 discloses a device for printing and dispensing labels in which a printing mechanism and a label strip advancing mechanism are actuated by movement of a secondary lever and the secondary lever is moved by a primary lever only after actuation of the primary lever to exceed a predetermined biasing force tending to maintain the secondary lever stationary.

U.S. Pat. No. 3,800,701 to William Martin dated Apr. 2, 1974 discloses a labeler having an actuator lever or pivot arm which is manually movable and which is connected to a print head. The actuator lever carries a pawl which cooperates with a tooth of the ratchet wheel to drive the feed wheel to advance the web. When the actuator lever is gripped the print head is pivoted into printing cooperation with the platen and upon release of the actuator lever a spring returns the actuator lever and the print head to an initial position and causes the pawl to drive the feed wheel.

SUMMARY OF THE INVENTION

This invention relates to a hand-held labeler in which the rate of movement of the print head into cooperation with the platen is essentially independent of the rate at which a manually actuated actuator is moved by the user. In accordance with a specific embodiment of the invention, the labeler includes a frame with a handle, an actuator disposed at the handle and movable between an initial position and an actuated position, a platen, a print head mounted for movement into and out of printing cooperation with the platen, a delaminator disposed adjacent the platen for delaminating printed labels from the supporting material web, an applicator disposed adjacent the delaminator for applying printed labels, a feed wheel engageable with the web for advancing the web, a stop on the actuator, a print head lever pivotally mounted on the frame, and a spring for urging the print head lever against the stop. Ratchet teeth are coupled to the feed wheel and a first pawl carried by the actuator and is cooperable with a ratchet tooth to drive the feed wheel to advance the web only after the print head has cooperated with the platen. The print head lever has a tooth. A second pawl mounted on the frame and engageable with the lever tooth after the actuator has moved from the initial position through an increment toward the actuated position is effective to prevent rotation of the lever as the actuator is moved through an additional increment toward the actuated position. The actuator carries structure for releasing the second pawl from the lever tooth when the actuator has moved through the additional increment to enable the spring to drive the print head into printing cooperation with the platen.

DETAILED DESCRIPTION OF THE PREFERRED EMBODIMENT

Figures 1, 2, 3, 4, 5:
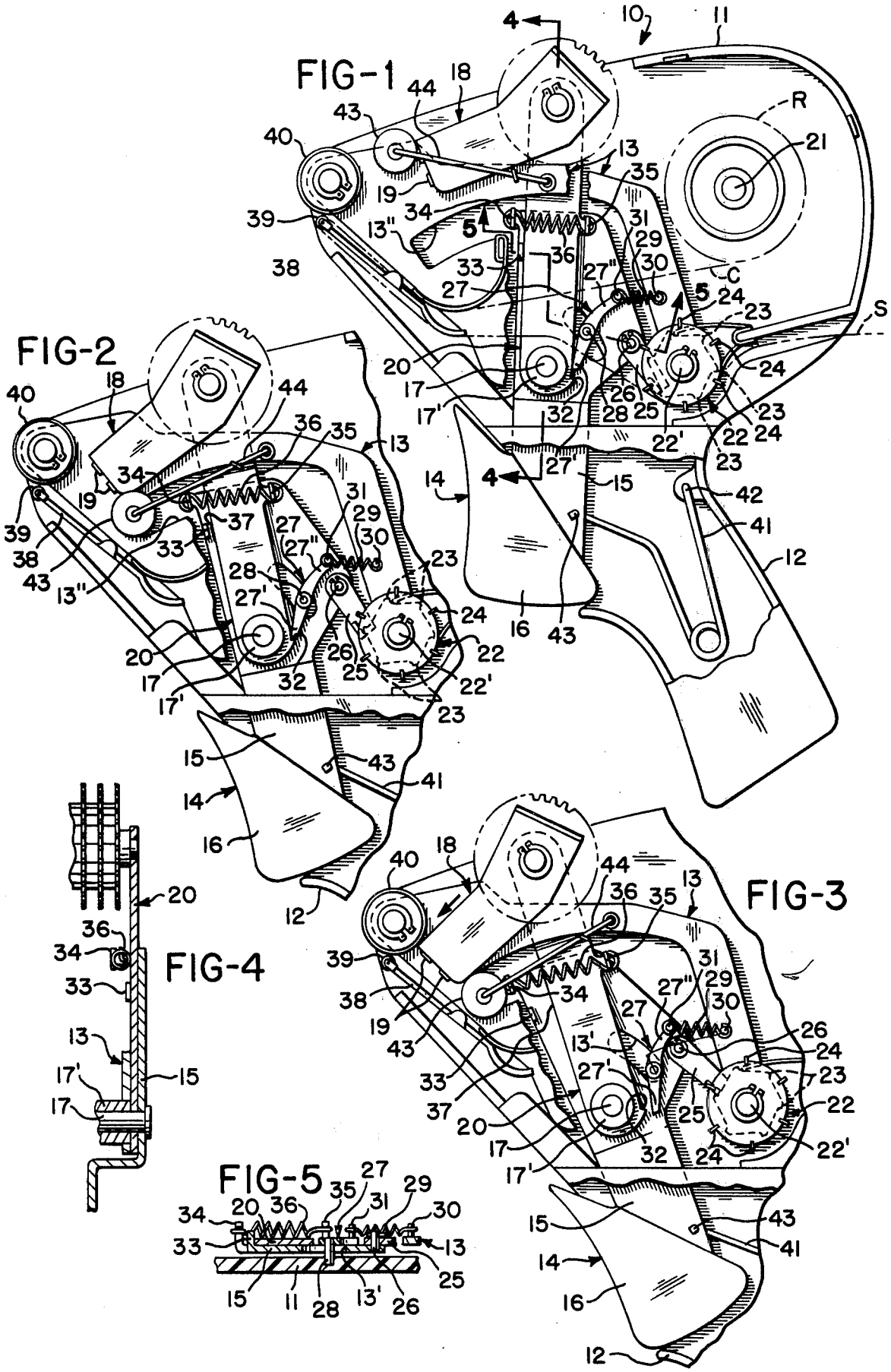
FIG. 1 is a side elevational view of a hand-held labeler in accordance with the invention with the component parts shown in their respective initial positions.
FIG. 2 is a fragmentary view similar to FIG. 1 but showing the actuator as having moved away from its initial position and showing the print head lever moved slightly relative to an actuator lever.
FIG. 3 is a fragmentary view similar to FIG. 2 but showing the actuator as having moved through an additional increment with the print head lever just being released and moving into printing cooperation with the platen.
FIG. 4 is a sectional view taken along line 4—4 of FIG. 1.
FIG. 5 is a sectional view taken along line 5—5 of FIG. 1.

With reference to FIG. 1 there is shown a labeler or label printing and applying apparatus generally indicated at 10 which includes a casing or frame 11 having a handle or handle portion 12. A fixed plate generally indicated at 13 is suitably secured in spaced relationship to the casing 11. An actuator generally indicated at 14 is shown to include an actuator lever 15 and a finger piece 16. A post 17 secured to the plate 13 pivotally mounts the lever 15. A print head generally indicated at 18 and having printing members 19 is fixed to a print head lever generally indicated at 20. The print head lever 20 is pivotally mounted on the post 17.

A post 21 rotatably mounts a supply roll R of a composite web C of labels releasably carried on a web of supporting material S. A feed wheel generally indicated at 22 is rotatably mounted on a post or shaft 22' and is disposed coaxially with respect to a series of ratchet teeth 23 which are secured to the feed wheel 22. The feed wheel has a plurality of teeth 24 which engage a supporting material web S. A pawl 25 pivotally mounted by a pin or post 26 to the lever 15 cooperates with successive teeth 23 to advance the web S. The pawl 25 is suitably urged into contact with the ratchet teeth by a spiral spring arrangement. A pawl or latch 27 is pivotally mounted to a pin or post 28 secured to the housing 11. The pawl 27 is spring urged by a tension spring 29 connected at one end portion to a pin or post 30 on the plate 13 and its other end portion to a pin or post 31 on the pawl 27. The pawl 27 is cooperable with a tooth 32 on the lever 20 adjacent the post 17.

The actuator lever 15 has a stop or abutment face 33. The post 17 is located generally between the finger piece 16 and the stop 33. The lever 15 has an upstanding tab 34 and the lever 20 has an upstanding tab 35. A tension spring 36 is connected at its one end portion to the tab 34 and at its other end portion to the tab 35. The tension spring 36 urges face 37 of the lever 20 against the stop 33.

The print head 18 is cooperable with a platen 38. A delaminator 39 is disposed adjacent the platen 38 and an applicator 40 shown to be in the form of a roll is disposed adjacent the delaminator 39. As the feed wheel 22 is driven, labels are delaminated from the supporting material web S and presented into label applying relationship with respect to the applicator 40 when the actuator 14 is released and the pawl 25 cooperates with a tooth 23 under the action of a spiral spring 41. The spring 41 is connected at one end portion 42 to the casing 11 and at its other end portion 43 to the lever 15. An ink roller 43 rotatably mounted on an arm 44 is spring urged to the position shown in FIG. 1.

In using the apparatus 10, the handle portion 12 is held in the user's hand and the finger piece 16 is engaged by at least one of the user's fingers. When the user grips the finger piece 16, the actuator lever 15 is pivoted counterclockwise. In that the spring 36 holds the lever 20 against the stop 33, the lever 20 also pivots counterclockwise and there is no relative movement between the levers 15 and 20. After movement of the actuator lever 15 through a first increment the pawl 27 engages the tooth 32. The lever 15 continues to pivot although the motion of the lever 20 is arrested by the pawl 27. FIG. 2 shows the lever 15 as having pivoted through a small arc relative to the lever 20. The lever 20 is out of contact with the stop 33 and the spring 36 is under greater tension than in the position shown in FIG. 1. When the lever 15 has moved through an additional increment, the pawl 27 is tripped by the rear portion of the pawl 25 so that the pawl 27 loses cooperation with the tooth 32 as shown in FIG. 3 and the spring 36 snaps the print head 18 into cooperation with the platen 38. Although the pawl 27 is released when the rear portion of the pawl 25 contacts arm 27' of the pawl 27, any suitably positioned projection on the actuator lever 15 can be used to trip the pawl 27. When the finger piece 16 is released, the spring 41 urges the lever 15 clockwise and as the lever 15 moves clockwise the spring 36 brings the lever 20 into contact with the stop 33. Continued movement of the actuator lever 15 returns the actuator lever 15, the print head lever 20, the print head 18, and the ink roller 43 to their initial positions shown in FIG. 1. As the lever 15 returns to the initial position, the pawl 25 engages and drives a tooth 23 to in turn drive the feed wheel 22 and advance the supporting material S. It is readily apparent that the printing force exerted on a label and the underlying platen 38 by the print head 18 is essentially independent of the speed of movement of the actuator 14 from the initial to the actuated position. It is also apparent that the supporting material web S can be fed only when the actuator 14 has been moved to the actuated position after the print head 18 has cooperated with the platen 38. With the foregoing arrangement, the just printed label is moved into label applying relationship with respect to the applicator 40 and thus no printed label is left in the labeler 10 after the completion of the cycle.

Other embodiments and modifications of this invention will suggest themselves to those skilled in the art, and all such of these as come within the spirit of this invention are included within its scope as best defined by the appended claims.

I claim:

1. Hand-held apparatus for printing and applying pressure sensitive labels releasably carried on a web of supporting material, comprising: a frame having a handle, an actuator disposed at the handle and movable between an initial position and an actuated position, a platen, a print head mounted for movement into and out of printing cooperation with the platen, means disposed adjacent the platen for delaminating printed labels from the supporting material web, means disposed adjacent the delaminating means for applying printed labels, a feed wheel engageable with the web for advancing the web, a stop on the actuator, a print head lever pivotally mounted on the frame, a spring for urging the print head lever against the stop, ratchet teeth coupled to the feed wheel, a first pawl carried by the actuator and cooperable with a ratchet tooth to drive the feed wheel to advance the web only after the print head has cooperated with the platen, the print head lever having a tooth, a second pawl mounted on the frame and engageable with the lever tooth after the actuator has moved from the initial position through an increment toward the actuated position, the second pawl being effective to prevent rotation of the lever as the actuator is moved through an additional increment toward the actuated position, and means carried by the actuator for releasing the second pawl from the lever tooth when the actuator has moved through the additional increment to enable the spring to drive the print head into printing cooperation with the platen.

2. Hand-held apparatus for printing and applying pressure sensitive labels releasably carried on a web of supporting material, comprising: a frame having a handle, a pivotally mounted actuator lever disposed at the handle and movable between an initial position and an actuated position, a platen, a print head, means disposed adjacent the platen for delaminating printed labels from the supporting material web, means disposed adjacent the delaminating means for applying printed labels, a feed wheel engageable with the web for advancing the web, a stop on the actuator lever, a pivotally mounted print head lever, a spring for urging the print head lever against the stop, ratchet teeth coupled to the feed wheel, a first pawl carried by the actuator lever and cooperable with a ratchet tooth to drive the feed wheel to advance the web only after the print head has cooperated with the platen, the print head lever having a tooth, a second pawl mounted on the frame and engageable with the lever tooth after the actuator lever has moved from the initial position through an increment toward the actuated lever position, means mounting the actuator and the print head lever for rotation on the frame, the second pawl being effective to prevent rotation of the print head lever as the actuator lever is moved through an additional increment toward the actuated position, and means carried by the actuator lever for releasing the second pawl from the print head lever tooth when the actuator lever has moved through the additional increment to enable the spring to drive the print head into printing cooperation with the platen.

3. Hand-held apparatus for printing and applying pressure sensitive labels releasably carried on a web of supporting material, comprising: a frame having a handle, an actuator disposed at the handle and movable between an initial position and an actuated position, a platen, a print head mounted for movement into and out of printing cooperation with the platen, means disposed adjacent the platen for delaminating printed labels from the supporting material web, means disposed adjacent the delaminating means for applying printed labels, a feed wheel engageable with the web for advancing the web, a stop on the actuator, a print head lever pivotally mounted on the frame, a spring acting on both the actuator and the print head lever for urging the print head lever against the stop, ratchet teeth coupled to the feed wheel, a first pawl carried by the actuator and cooperable with a ratchet tooth to drive the feed wheel to advance the web only after the print head has cooperated with the platen, the print head lever having a tooth, a second pawl mounted on the frame and engageable with the lever tooth after the actuator has moved from the initial position through an increment toward the actuated position, the second pawl being effective to prevent rotation of the lever as the actuator is moved through an additional increment toward the actuated position, and means carried by the actuator for releasing the second pawl from the lever tooth when the actuator has moved through the additional increment to enable the spring to drive the print head into printing cooperation with the platen.

4. Hand-held apparatus for printing and applying pressure sensitive labels releasably carried on a web of supporting material, comprising: a frame having a handle, an actuator disposed at the handle and movable between an initial position and an actuated position, a platen, a print head mounted for movement into and out of printing cooperation with the platen, means disposed adjacent the platen for delaminating printed labels from the supporting material web, means disposed adjacent the delaminating means for applying printed labels, a feed wheel engageable with the web for advancing the web, a stop on the actuator, a print head lever pivotally mounted on the frame, a spring for urging the print head lever against the stop, ratchet teeth coupled to the feed wheel, a first pawl carried by the actuator and cooperable with a ratchet tooth to drive the feed wheel to advance the web only after the print head has cooperated with the platen, the print head lever having a tooth, a second pawl mounted on the frame and engageable with the lever tooth after the actuator has moved from the initial position through an increment toward the actuated position, the second pawl being effective to prevent rotation of the lever as the actuator is moved through an additional increment toward the actuated position, means carried by the actuator for releasing the second pawl from the lever tooth when the actuator has moved through the additional increment to enable the spring to drive the print head into printing cooperation with the platen, and a spring for returning the actuator and the print head lever to their initial positions and for causing the first pawl to drive a ratchet tooth and hence the feed wheel.

5. Hand-held apparatus for printing and applying pressure sensitive labels releasably carried on a web of supporting material, comprising: a frame having a handle, a pivotally mounted actuator lever disposed at the handle and movable between an initial position and an actuated position, a platen, a print head, means disposed adjacent the platen for delaminating printed labels from the supporting material web, means disposed adjacent the delaminating means for applying printed labels, a feed wheel engageable with the web for advancing the web, a stop on the actuator lever, wherein the actuator and print head levers are pivotally mounted on the same axis, a spring for urging the print head lever against the stop, ratchet teeth coupled to the feed wheel, a first pawl carried by the actuator lever and cooperable with a ratchet tooth to drive the feed wheel to advance the web only after the print head has cooperated with the platen, the print head lever having a tooth, a second pawl mounted on the frame and engageable with the lever tooth after the actuator lever has moved from the initial position through an increment toward the actuated position, means mounting the actuator lever and the print head lever for rotation on the frame, the second pawl being effective to prevent rotation of the print head lever as the actuator lever is moved through an additional increment toward the actuated position, and means carried by the actuator lever for releasing the second pawl from the print head lever tooth when the actuator lever has moved through the additional increment to enable the spring to drive the print head into printing cooperation with the platen.

6. Hand-held apparatus for printing and applying pressure sensitive labels releasably carried on a web of supporting material, comprising: a frame having a handle, a pivotally mounted actuator lever disposed at the handle and movable between an initial position and an actuated position, a platen, a print head, means disposed adjacent the platen for delaminating printed labels from the supporting material web, means disposed adjacent the delaminating means for applying printed labels, a feed wheel engageable with the web for advancing the web, a stop on the actuator lever, a pivotally mounted print head lever, a spring for urging the print head lever against the stop, wherein the spring is a tension spring which is connected to both the actuator and print head lever, ratchet teeth coupled to the feed wheel, a first pawl carried by the actuator lever and cooperable with a ratchet tooth to drive the feed wheel to advance the web only after the print head has cooperated with the platen, the print head lever having a tooth, a second pawl mounted on the frame and engageable with the lever tooth after the actuator lever has moved from the initial position through an increment toward the actuated position, means mounting the actuator lever and the print head lever for rotation on the frame, the second pawl being effective to prevent rotation of the print head lever as the actuator lever is moved through an additional increment toward the actuated position, and means carried by the actuator lever for releasing the second pawl from the print head lever tooth when the actuator lever has moved through the additional increment to enable the spring to drive the print head into printing cooperation with the platen.

7. Hand-held apparatus for printing and applying pressure sensitive labels releasably carried on a web of supporting material, comprising: a frame having a handle, a pivotally mounted actuator lever disposed at the handle and movable between an initial position and an actuated position, a platen, a print head, means disposed adjacent the platen for delaminating printed labels from the supporting material web, means disposed adjacent the delaminating means for applying printed labels, a feed wheel engageable with the web for advancing the web, a stop on the actuator lever, a pivotally mounted print head lever, a spring for urging the print head lever against the stop, ratchet teeth coupled to the feed wheel, a first pawl carried by the actuator lever and cooperable with a ratchet tooth to drive the feed wheel to advance the web only after the print head has cooperated with the platen, the print head lever having a tooth, a second pawl mounted on the frame and engageable with the lever tooth after the actuator lever has moved from the initial position through an increment toward the actuated position, means mounting the actuator lever and the print head lever for rotation of the frame, wherein the mounting means includes a post secured to the frame, the actuator and print head levers being mounted for independent pivotaly movement on the post, the second pawl being effective to prevent rotation of the print head lever as the actuator lever is moved through an additional increment toward the actuated position, and means carried by the actuator lever for releasing the second pawl from the print head lever tooth when the actuator lever has moved through the additional increment to enable the spring to drive the print head into printing cooperation with the platen.

8. Hand-held apparatus for printing and applying pressures sensitive labels releasably carried on a web of supporting material, comprising: a frame having a handle, a pivotally mounted actuator lever disposed at the handle and movable between an initial position and an actuated position, a platen, a print head, means disposed adjacent the platen for delaminating printed labels from the supporting material web, means disposed adjacent the delaminating means for applying printed labels, a feed wheel engageable with the web for advancing the web, a stop on the actuator lever, a pivotally mounted print head lever, a spring for urging the print head lever against the stop, wherein the spring acts on both the actuator and print head levers, ratchet teeth coupled to the feed wheel, a first pawl carried by the actuator lever and cooperable with a ratchet tooth to drive the feed wheel to advance the web only after the print head has cooperated with the platen, the print head lever having a tooth, a second pawl mounted on the frame and engageable with the lever tooth after the actuator lever has moved from the initial position through an increment toward the actuated position, means mounting the actuator lever and the print head lever for rotation on the frame, the second pawl being effective to prevent rotation of the print head lever as the actuator lever is moved through an additional increment toward the actuated position, and means carried by the actuator lever for releasing the second pawl from the print head lever tooth when the actuator lever has moved through the additional increment to enable the spring to drive the print head into printing cooperation with the platen.

9. Hand-held apparatus for printing and applying pressure sensitive labels releasably carried on a web of supporting material, comprising: a frame having a handle, a pivotally mounted actuator lever disposed at the handle and movable between an initial position and an actuated position, a platen, a print head, means disposed adjacent the platen for delaminating printed labels from the supporting material web, means disposed adjacent the delaminating means for applying printed labels, a feed wheel engageable with the web for advancing the web, a stop on the actuator lever, a pivotally mounted print head lever, a spring for urging the print head lever against the stop, ratchet teeth coupled to the feed wheel, a first pawl carried by the actuator lever and cooperable with a ratchet tooth to drive the feed wheel to advance the web only after the print head has cooperated with the platen, the print head lever having a tooth, a second pawl mounted on the frame and engageable with the lever tooth after the actuator lever has moved from the initial position through an increment toward the actuated position, means mounting the actuating lever and the print head lever for rotation on the frame, the second pawl being effective to prevent rotation of the print head lever as the actuator lever is moved through an additional increment toward the actuated position, means carried by the actuator lever for releasing the second pawl from the print head lever tooth when the actuator lever has moved through the additional increment to enable the spring to drive the print head into printing cooperation with the platen, and a spring for returning the actuator and print head levers to their initial position and for causing the first pawl to drive a ratchet tooth and hence the feed wheel.

* * * * *

UNITED STATES PATENT AND TRADEMARK OFFICE

CERTIFICATE OF CORRECTION

PATENT NO. : 4,125,420

DATED : November 14, 1978

INVENTOR(S) : Paul H. Hamisch, Jr.

It is certified that error appears in the above-identified patent and that said Letters Patent are hereby corrected as shown below:

Column 4, line 56, omit "lever" after "actuated"; line 57, after "actuator", insert --lever--.

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*